US006575718B2

(12) United States Patent
Onishi et al.

(10) Patent No.: US 6,575,718 B2
(45) Date of Patent: Jun. 10, 2003

(54) HIGH PRESSURE FUEL SUPPLY APPARATUS

(75) Inventors: Yoshihiko Onishi, Tokyo (JP); Kouichi Ojima, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 73 days.

(21) Appl. No.: 09/941,772

(22) Filed: Aug. 30, 2001

(65) Prior Publication Data

US 2002/0025266 A1 Feb. 28, 2002

(30) Foreign Application Priority Data

Aug. 13, 2000 (JP) ..... 2000-263195

(51) Int. Cl.[7] ..... F04B 39/10
(52) U.S. Cl. ..... 417/571; 417/569
(58) Field of Search ..... 417/571, 269, 417/540, 569; 123/446, 447, 458; 137/512, 527, 856

(56) References Cited

U.S. PATENT DOCUMENTS 5,209,260 A * 5/1993 Baek ..... 137/527
5,454,397 A * 10/1995 Miszczak ..... 137/512
5,558,508 A * 9/1996 Sasano et al. ..... 417/569
5,885,064 A * 3/1999 McCoy ..... 417/569
6,113,369 A * 9/2000 Selway ..... 417/569
6,116,874 A * 9/2000 Nation et al. ..... 417/571
6,209,522 B1 * 4/2001 Onishi et al. ..... 123/458
6,223,724 B1 * 5/2001 Miyaji et al. ..... 123/446
6,227,825 B1 * 5/2001 Vay ..... 417/569
6,343,588 B1 * 2/2002 Onishi et al. ..... 123/506
6,461,126 B1 * 10/2002 Pierobon ..... 417/569

FOREIGN PATENT DOCUMENTS

JP 11-159416 6/1999 ..... F02M/59/44

* cited by examiner

*Primary Examiner*—Teresa Walberg
*Assistant Examiner*—Vinod D. Patel
(74) *Attorney, Agent, or Firm*—Sughrue Mion, PLLC

(57) ABSTRACT

A high pressure fuel supply apparatus includes a cylinder defining a compression chamber, a piston supported for sliding movement in the cylinder, and a valve communicating with the compression chamber. The valve includes a valve seat having a valve hole formed therein and a reed movable between an open and a closed position to open and close the valve hole. The reed has a head with an outer periphery in surface contact with the valve seat when the reed is in its closed position, and a bulge surrounded by the outer periphery and extending away from the valve hole and disposed on the valve hole when the 0reed is in its closed position.

8 Claims, 6 Drawing Sheets

HIGH PRESSURE FUEL SUPPLY APPARATUS

REFERENCE TO RELATED APPLICATIONS

This application is based on Japanese Patent Application No. 2000-263195, filed in Japan on Aug. 31, 2000, the contents of which are hereby incorporated by reference.

BACKGROUND OF THE INVENTION

This invention relates to a fuel supply apparatus. In particular, it relates to a high pressure fuel supply apparatus for supplying a fuel under high pressure to an internal combustion engine.

FIG. 8 schematically illustrates a typical fuel supply system for an automotive internal combustion engine equipped with fuel injectors. As shown in this figure, fuel 2 within a fuel tank 1 is discharged from the fuel tank 1 by a low pressure pump 3 and passes through a filter 4, and after its pressure is adjusted by a low pressure regulator 5, it is supplied to a high pressure fuel supply apparatus 6. The fuel is pressurized by the fuel supply apparatus 6 and is supplied to a common rail 9 of an internal combustion engine (not shown). Excess fuel not needed by the engine is transferred by an electromagnetic valve 17 to a point between a low pressure damper 12 and an intake valve 13. A control unit (not shown) determines the necessary amount of fuel to be supplied to the engine and controls the electromagnetic valve 17 accordingly. The high pressure fuel which is supplied in this manner is sprayed as a high pressure mist from fuel injectors 10 connected to the common rail 9 and is injected into cylinders (not shown) of the internal combustion engine. A high pressure relief valve 8 connected to the discharge side of the supply apparatus 6 through a filter 7 opens when there is an abnormal pressure within the common rail 9 and prevents damage to the common rail 9 and the fuel injectors 10.

The high pressure fuel supply apparatus 6 includes a filter 11 which filters the supplied fuel, the above-mentioned low pressure damper 12 which absorbs pressure pulses of the low pressure fuel, and a pump 16 which pressurizes fuel which is supplied through the intake valve 13 and discharges high pressure fuel through a discharge valve 14 and a fuel pressure maintaining valve 15.

FIG. 9 illustrates the actual structure of an example of the high pressure fuel supply apparatus 6 schematically illustrated in FIG. 8. As shown in FIG. 9, the high pressure fuel supply apparatus 6 has a casing 21 containing a cylinder 25 which defines a compression chamber 24 of a high pressure pump 16. The casing 21 also includes an intake passage 22 for fuel to be pressurized in the compression chamber 24 and a discharge passage 23 for pressurized fuel. A piston 26 in the form of a plunger is supported in the cylinder 25 for sliding movement in the axial direction thereof so as to vary the volume of the compression chamber 24. A compression spring 27 is provided at the inner end (the upper end in FIG. 9) of the piston 26, and at the outer end (the lower end in FIG. 9) an operating member in the form of a tappet 28 which receives a drive force from the camshaft of the unillustrated engine and transmits it to the piston 26 is supported by a bracket 30 for sliding movement in the axial direction of the piston 26.

The high pressure fuel supply apparatus 6 comprises, as a unitary structure, the high pressure pump 16 which is a plunger pump for example, the electromagnetic valve 17 connected to the compression chamber 24 of the high pressure pump 16, and the low pressure damper 12. The high pressure fuel supply apparatus 6 also includes a metal bellows 29 which substantially surrounds the cylinder 25 and the piston 26 and which prevents fuel which leaks out from between the cylinder 25 and the piston 26 from leaking to the outside of the apparatus 6.

The piston 26 is driven up and down in FIG. 9 by a drive cam mounted on an unillustrated camshaft, and fuel is sucked into and discharged from the compression chamber 24 by the movement of the piston 26. The electromagnetic valve 17 is opened when a prescribed amount of fuel is discharged into the common rail 9, so that some of the high pressure fuel within the compression chamber 24 is sent (released) to the inlet side rather than being sent under pressure to the common rail 9. By controlling the timing of opening of the electromagnetic valve 17, the amount of fuel discharged from the fuel supply apparatus 6 can be variably controlled.

Low pressure fuel from the fuel tank 1 passes through an intake valve 13 into the compression chamber 24, and is then discharged from the compression chamber 24 through a discharge valve 14. FIG. 10 is an enlarged view of region A of FIG. 9, showing a valve assembly including the intake valve 13 and the discharge valve 14, and FIGS. 11–16 show various portions of the valve assembly in detail. The valve assembly includes an upper plate 33, a lower plate 31, and a reed plate 33 sandwiched between the upper and lower plates 33 and 31. As shown in plan in FIG. 11, the upper plate 33 is a disk-shaped member having a relief flow passage 34 which communicates with the electromagnetic valve 17, two valve holes 35 which function as intake openings, and a cavity 36 which communicates with the discharge passage 23 and which has a size and shape so as not to interfere with the movement of a discharge valve reed 38 of the reed plate 32. As shown in plan in FIG. 12, the reed plate 32 is a thin disk-shaped member having two flat intake valve reeds 37 and a flat discharge valve reed 38. As shown in plan in FIG. 13, the lower plate 31 is a disk-shaped member having a cavity 39 which communicates with the compression chamber 24 and has a size and shape so as not to interfere with the movement of the intake valve reeds 37, and a valve hole 40 which functions as a discharge opening.

FIG. 14 is an enlarged plan view of the discharge valve reed 38 of FIG. 12, FIG. 15 is a cross-sectional elevation taken along line 15—15 of FIG. 14, and FIG. 16 is an enlarged cross-sectional elevation taken along line 16—16 of FIG. 14. The discharge valve reed 38 includes a flexible neck 42 and a disk-shaped head 43 which is secured to one end of the neck 42 and which can move between an open and a closed position to open and close the valve hole 40 of the lower plate 31. In FIG. 16, the dashed lines show the shape of the reed 38 in an unloaded state, and the solid lines show the shape when the discharge side of the valve assembly is at a higher pressure than the compression chamber 24 and the reed 38 is pressed against and closes the valve hole 40. The discharge valve reed 38 is strongly pressed by the high pressure P on the discharge side, so the reed 38 is deformed downwards at its center into the shape of a bowl such that the reed 38 is in sealing contact with substantially only the edge 41 of the valve hole 40. The amount of deformation of the reed 38 in its deformed state with respect to its shape in an unloaded state is H. The seal due to contact between the reed 38 and the edge 41 of the valve hole 40 is an edge seal involving line contact between the two members. This edge seal generates a large local stress in the seal portion of the discharge valve reed 38. Furthermore, the discharge valve reed 38 has a high stiffness at its neck 42, so the deformed shape of the head 43 when subjected to pressure is different where the head 43 adjoins the neck 42 than in other locations, so a gap develops in this region, and the sealing performance decreases (particularly at the border 44 of the neck 42 and the head 43). This same problem occurs with the intake valve reeds 37.

The thickness of the reed plate 32 is usually very thin, such as on the order of 0.3 mm, in order to decrease stresses generated at the time of valve opening and pressure losses. Therefore, in the device of FIG. 9, when the discharge pressure is set to a value such as 12 MPa, a defective seal can easily occur due to high stresses which are generated at the time of valve closing and deformation of reed 38, and damage to the reed plate 32 and a decrease in the discharge of the fuel supply apparatus 6 may occur. In the past, in order to cope with such problems, it was necessary to increase the thickness of reed 38 or decrease the diameter of the valve hole 40 in plate 33. However, in order to decrease pressure losses at the time of valve opening, it was necessary to elongate the neck 42 of the reed 38 or to increase the number of intake valves, so the high pressure fuel supply apparatus ended up being large in size. The same problem occurs with respect to the intake valve reeds 37.

SUMMARY OF THE INVENTION

The present invention provides a high pressure flow supply apparatus which can increase the stiffness of a valve reed without changing the thickness of a plate in which the reed is formed or the size of a valve hole covered by the reed, which can achieve a surface seal, and which can provide a valve having improved sealing properties and resistance to pressure.

According to one form of the present invention, a high pressure fuel supply apparatus includes a cylinder defining a compression chamber, a piston supported for sliding movement in the cylinder, and a valve communicating with the compression chamber. The valve includes a valve hole and a reed movable between an open and a closed position to open and close the valve hole. The reed has a head with an outer periphery in surface contact with a surface surrounding the valve hole when the reed is in its closed position, and a bulge surrounded by the outer periphery and extending away from the valve hole and disposed on the valve hole when the reed is in its closed position.

In a preferred embodiment, the bulge in the reed has generally the shape of a bowl.

The bulge in the reed preferably has a height which is at least 0.9 times the thickness of the reed.

DESCRIPTION OF PREFERRED EMBODIMENTS

Figure 1:
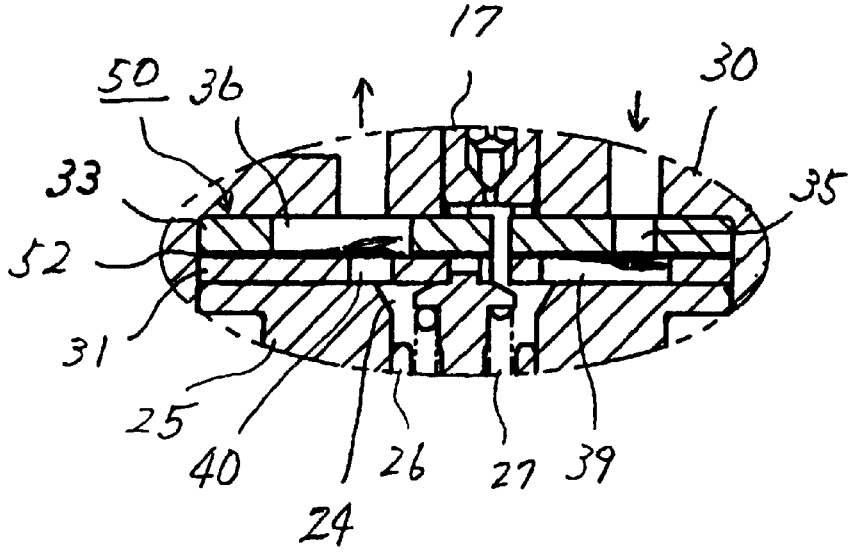
FIG. 1 is an enlarged cross-sectional view of a region corresponding to region A in FIG. 9 showing a valve assembly of an embodiment of a high pressure fuel supply apparatus according to the present invention.
Figure 8:
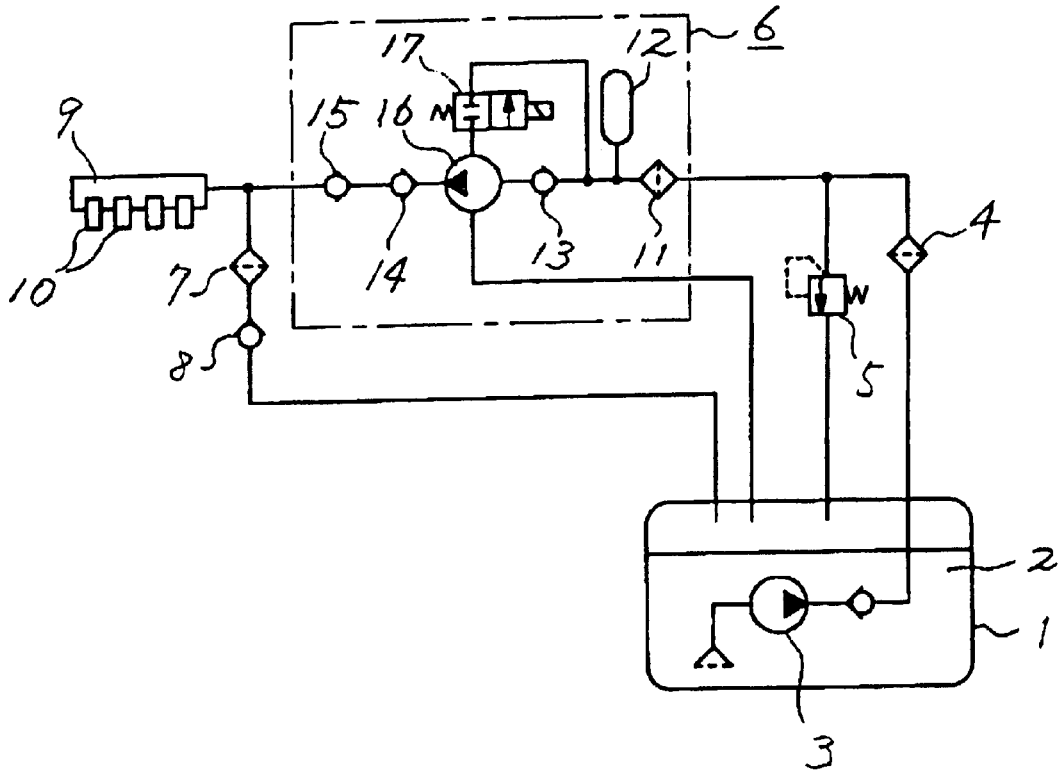
FIG. 8 PRIOR ART
FIG. 8 is a schematic illustration of a typical fuel supply system to which a high pressure fuel supply apparatus according to the present invention can be applied.
Figure 9:
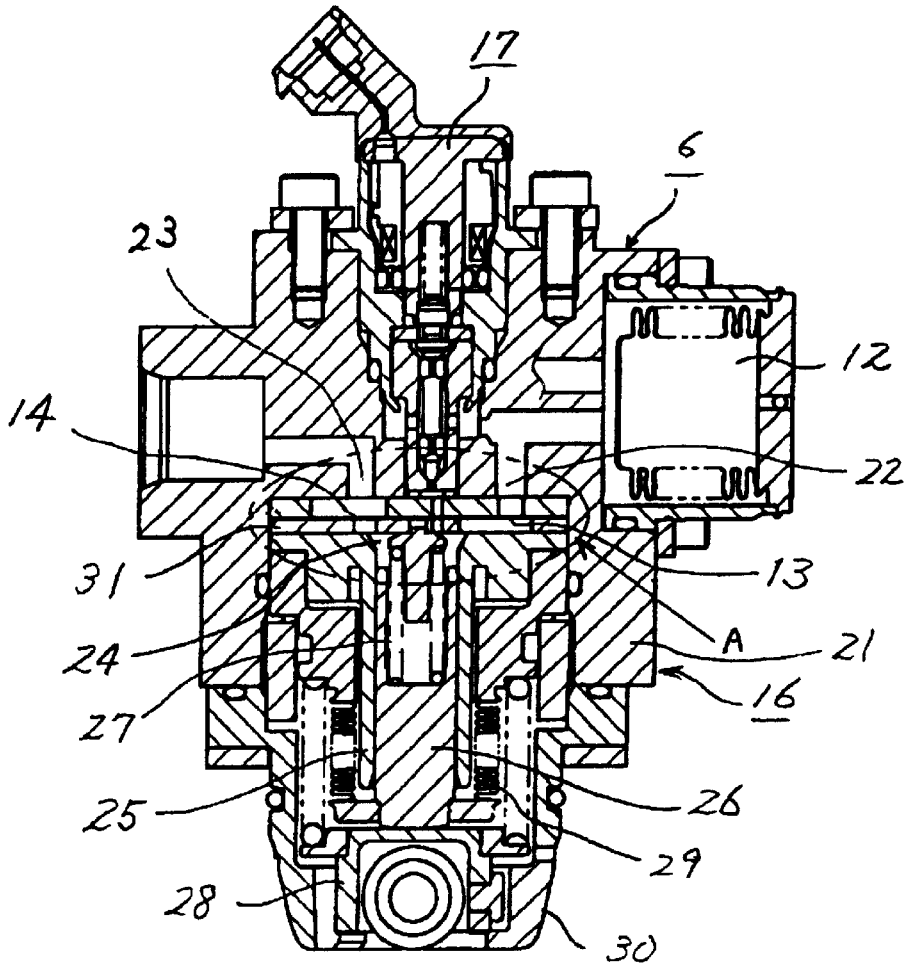
FIG. 9 is a cross-sectional elevation of a high pressure fuel supply apparatus.
Figure 10:
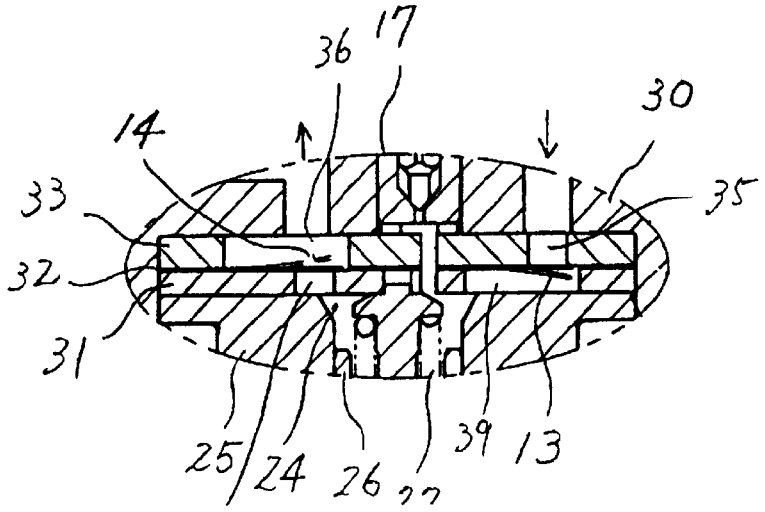
FIG. 10 is an enlarged cross-sectional view of region A in FIG. 9, showing a valve assembly.

A preferred embodiment of a high pressure flow supply apparatus according to the present invention will next be described while referring to the accompanying drawings. The overall structure of this embodiment is similar to that of the apparatus shown in FIG. 9, and it can be employed in a fuel supply system like the one schematically illustrated in FIG. 8 in the same manner as the apparatus of FIG. 9. This embodiment differs from the apparatus of FIG. 9 with respect to the structure of a valve assembly thereof. FIG. 1 is an enlarged view of a portion of this embodiment corresponding to region A of FIG. 9, showing the valve assembly of this embodiment. The valve assembly defines an intake valve and a discharge valve communicating with a compression chamber 24 and includes an upper plate 33, a lower plate 31, and a reed plate 52 sandwiched between the upper and lower plates 33 and 31. The structure of this embodiment is otherwise the same as that of the apparatus of FIG. 9.

Figure 2:
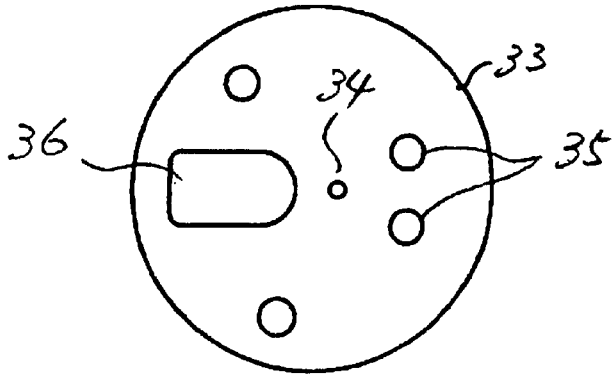
FIG. 2 is a plan view of the upper plate of the valve assembly of FIG. 1.
Figure 3:
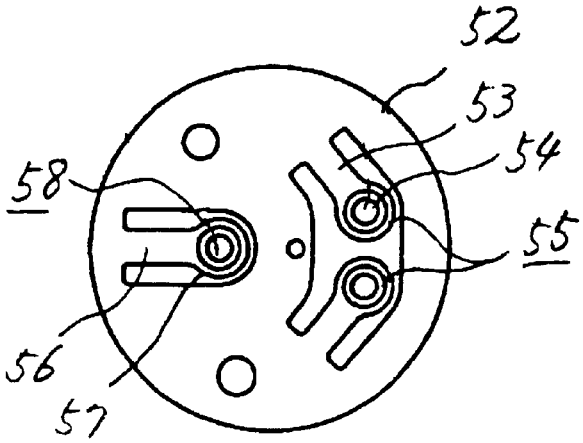
FIG. 3 is a plan view of the reed plate of the valve assembly of FIG. 1.
Figure 4:
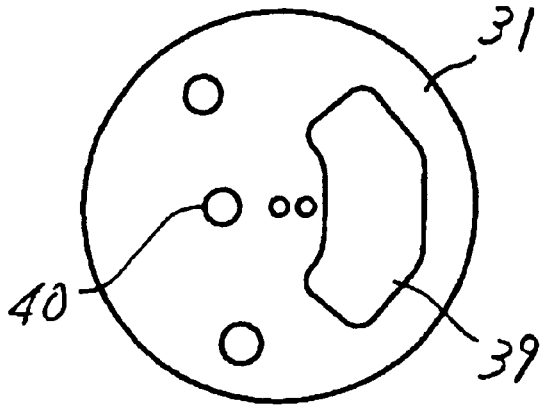
FIG. 4 is a plan view of the lower plate of the valve assembly of FIG. 1.
Figure 11:
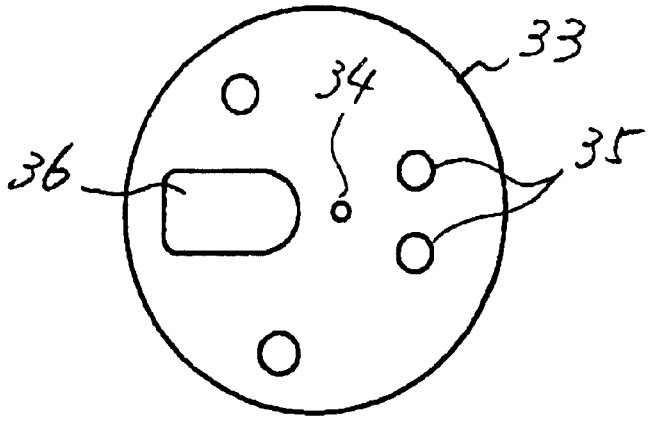
FIG. 11 is a plan view of the upper plate of the valve assembly of FIG. 10.
Figure 12:
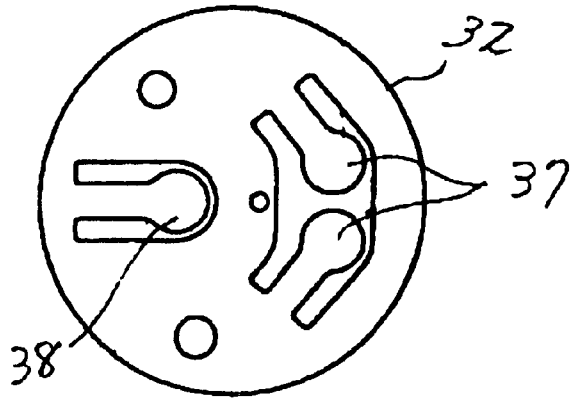
FIG. 12 is a plan view of the reed plate of the valve assembly of FIG. 10.
Figure 13:
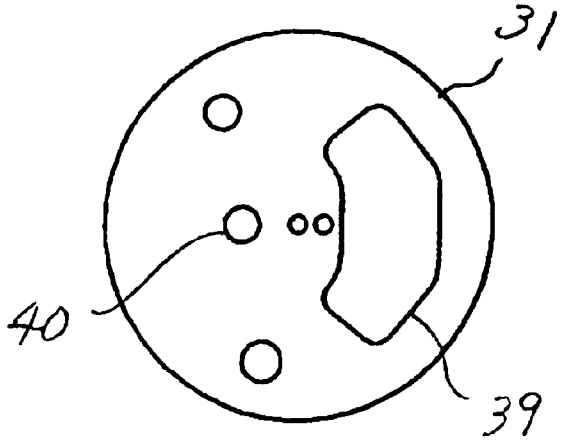
FIG. 13 is a plan view of the lower plate of the valve assembly of FIG. 10.
Figure 14:
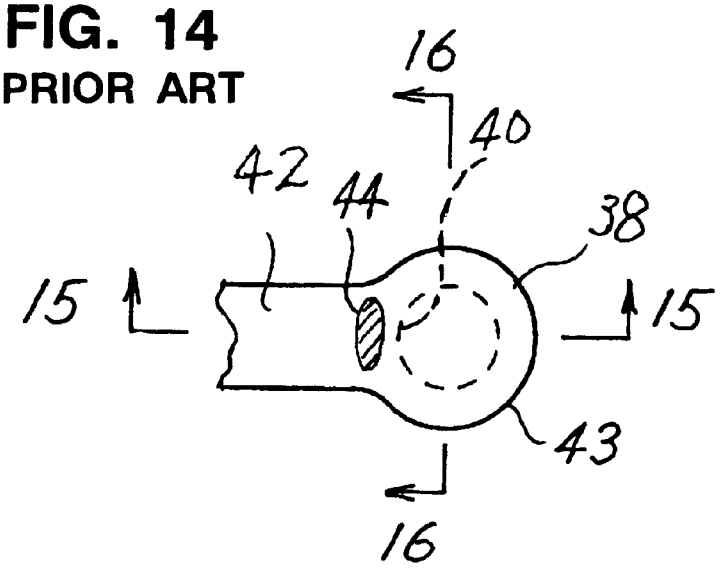
FIG. 14 PRIOR ART
FIG. 14 is an enlarged plan view of the discharge valve reed of the reed plate of FIG. 12.
Figure 15:
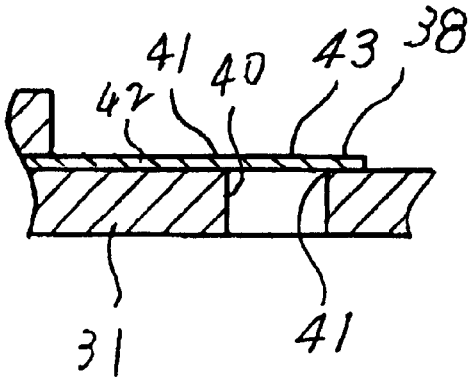
FIG. 15 PRIOR ART
FIG. 15 is a cross-sectional elevation taken along line 15—15 of FIG. 14.

The upper plate 33 (shown in plan in FIG. 2) and the lower plate 31 (shown in plan in FIG. 4) of the valve assembly have the same structure as the upper and lower plates 33 and 31 shown in FIGS. 11 and 13, respectively. Namely, the upper plate 33 is a disk-shaped member having a relief flow passage 34 which communicates with the electromagnetic valve 17, two valve holes 35 which function as intake openings, and a cavity 36 which communicates with the discharge passage 23 and which has a size and shape so as not to interfere with the movement of a discharge valve reed 58 of the reed plate 52. Similarly, the lower plate 31 is a disk-shaped member having a cavity 39 which communicates with the compression chamber 24 and has a size and shape so as not to interfere with the movement of intake valve reeds 55 of the reed plate 52, and a valve hole 40 which functions as a discharge opening. The reed plate 52, which is shown in plan in FIG. 3, has the same overall shape as the reed plate 32 of FIG. 12. Like reed plate 32, it is a thin disk-shaped member which includes two intake valve reeds 55 bendable between an open and a closed position for opening and closing the valve holes 35 in the upper plate 33, and a discharge valve reed 58 bendable between an open and a closed position for opening and closing the valve hole 40 in the lower plate 31. Each of the intake valve reeds 55 includes a flexible neck 53 and a disk-shaped head 54 connected to one end of the neck 53.

Similarly, the discharge valve reed 58 includes a flexible neck 56 and a disk-shaped head 57 connected to one end of the neck 56.

Figure 5:
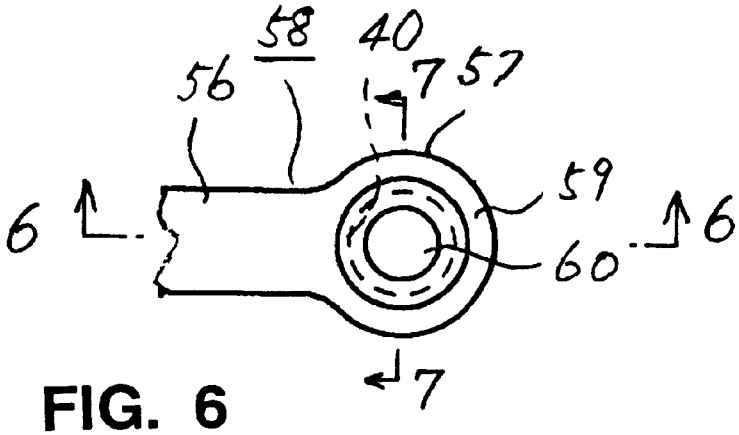
FIG. 5 is an enlarged plan view of the discharge valve reed of the reed plate of FIG. 3.
Figure 6:
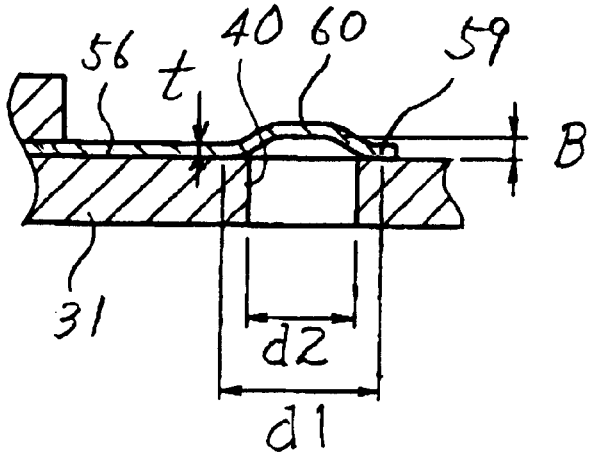
FIG. 6 is a cross-sectional elevation taken along line 6—6 of FIG. 5.

FIG. 5 is an enlarged plan view showing the structure of the discharge valve reed 58 in greater detail, and FIG. 6 is a cross-sectional elevation taken along line 6—6 of FIG. 5. As shown in these figures, the head 57 of the discharge valve reed 58 has a flat, annular outer periphery 59 having an inner diameter d1 which is larger than the diameter d2 of the valve hole 40, which is typically circular. When the reed 58 is in its closed position as shown in FIG. 6 in which it closes the valve hole 40, the lower surface of the outer periphery 59 is in surface contact with a flat portion of the upper surface of the lower plate 31 surrounding the valve hole 40, this portion of the upper surface acting as a valve seat for the head 57 of the reed 58. The head 57 of the reed 58 also includes a bowl-shaped bulge 60 which is surrounded by the outer periphery 59 and projects away from the valve hole 40. In other words, the bulge 60 has an outer diameter equal to d1. When the reed 58 is in its closed position shown in FIG. 6, the bulge 60 is disposed on the valve hole 40. The bulge 60 may be formed in the reed 58 by any suitable method, such as by press working. The present inventors found that particularly good results can be obtained if the height B of the bulge 60 relative to the outer periphery 59 is at least 0.9 times the thickness t of the discharge valve reed 58. The intake valve reeds 55 are similar in structure to the discharge valve reed 58, with the head 54 of each reed 55 having a flat outer periphery which forms a surface seal against the lower surface of the upper plate 33 surrounding one of valve holes 35 and a bulge surrounded by the outer periphery. Each of the bulges in the intake valve reeds projects away from the corresponding valve hole 35 and preferably has a height which is at least 0.9 times the thickness of the reed 55.

Figure 7:
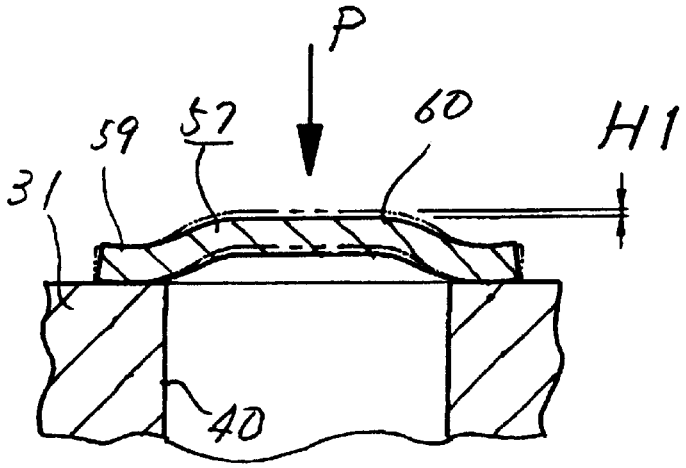
FIG. 7 is an enlarged cross-sectional elevation taken along line 7—7 of FIG. 5 showing the discharge valve reed in a loaded state (solid lines) and an unloaded state (dashed lines).
Figure 16:
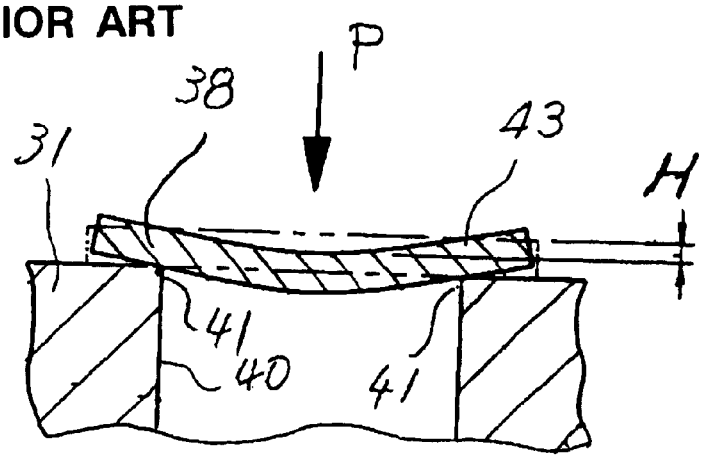
FIG.16 PRIOR ART
FIG. 16 is an enlarged cross-sectional elevation taken along line 16—16 of FIG. 14 showing the discharge valve reed in a loaded state (solid lines) and an unloaded state (dashed lines).

FIG. 7 is an enlarged cross-sectional view taken along line 7—7 of FIG. 5 and schematically showing the shape of the head 57 of the discharge valve reed 58 during a loaded state (solid lines) when subjected to a pressure P from the discharge side of the valve assembly to close the valve hole 40, such as when the pump 16 is performing suction, and during an unloaded state (dashed lines). As shown in this figure, the head 57 is strongly pressed towards the upper surface of the lower plate 31 by the high pressure P, and the outer periphery 59 of the head 57 is pressed into surface contact with the valve seat surrounding the valve hole 40 to form a seal. The bulge 60 increases the stiffness of the head 57 compared to that of a flat head of the same thickness, so the amount of deformation H1 of the head 57 due to the pressure P is much smaller than the amount of deformation H of the flat head 43 of the same thickness of the discharge valve reed 38 shown in FIG. 16.

Accordingly, due to the provision of the bulge 60 in the head 57 of the discharge valve reed 58, the head 57 has a high stiffness against a pressure acting in the reed closing direction, so the deformation of the head 57 can be limited to a very small amount, local deformation of the neck 56 of the reed 58 can be decreased, and the sealing performance of the discharge valve reed 58 can be increased without changing the thickness of the head 57 or the diameter of the valve hole 40. Furthermore, by making the outer diameter of the bulge 60 larger than the diameter of the valve hole 40, even when a pressure is applied in the valve closing direction, the support point of deformation remains on the flat upper surface of the lower plate 33, so an edge seal between the head 57 and the valve hole 40 does not take place, and the generation of localized stresses in the reed 58 can be prevented. In addition, the outer diameter of the head 57 is larger than in the apparatus of FIG. 9, so pressure losses in the valve can be reduced. In addition, a considerably larger discharge pressure (such as 12 MPa) than the discharge pressure (such as 5 MPa) of the apparatus of FIG. 9 can be coped with without increasing the size of the high pressure flow supply apparatus. Alternatively, if the discharge pressure is not increased, the high pressure flow supply apparatus can be reduced in size compared to that of the apparatus of FIG. 9, and the sealing performance can be improved. Furthermore, since the diameter of the head 57 is larger than the diameter of the valve hole 40 and the outer periphery 59 is in surface contact with the valve seat surrounding the valve hole 40, the dimensional accuracy of the diameter of the valve hole 40 can be lower than that required in the apparatus of FIG. 9, i.e., the dimensional tolerance of the valve hole 40 can be increased, so manufacturing costs can be decreased. The intake valve reeds 55 provide the same advantages as the discharge valve reed 58.

This embodiment operates in the same manner as described above with respect to the apparatus illustrated in FIG. 9, so a description of the operation will not be repeated.

As described above, according to one form of the present invention, a high pressure fuel supply apparatus includes a cylinder defining a compression chamber, a piston supported for sliding movement in the cylinder, and a valve communicating with the compression chamber and comprising a valve hole and a reed movable between an open and a closed position to open and close the valve hole, the reed having a head with an outer periphery in surface contact with a surface surrounding the valve hole when the reed is in its closed position, and a bulge surrounded by the outer periphery and extending away from the valve hole and disposed on the valve hole when the reed is in its closed position. Therefore, the stiffness of the reed is increased without changing its thickness, the reed can form a surface seal around the valve hole, and sealing properties and resistance to pressure are enhanced.

What is claimed is:

1. A fuel supply apparatus comprising a cylinder defining a compression chamber, a piston supported for sliding movement in the cylinder to vary a volume of the compression chamber, and a valve communicating with the compression chamber and comprising a valve hole and a reed movable between an open and a closed position to open and close the valve hole, the reed having a head with an outer periphery in surface contact with a surface surrounding the valve hole when the reed is in its closed position, and a bulge surrounded by the outer periphery and extending away from the valve hole and disposed above the valve hole when the reed is in its closed position.

2. A fuel supply apparatus as claimed in claim 1 wherein the bulge is generally bowl shaped.

3. A fuel supply apparatus as claimed in claim 1 wherein the outer periphery of the head of the reed is flat.

4. A fuel supply apparatus as claimed in claim 1 wherein the bulge has an outer diameter larger than a diameter of the valve hole.

5. A fuel supply apparatus as claimed in claim 1 wherein the bulge has a height which is at least 0.9 times a thickness of the reed.

6. A fuel supply apparatus as claimed in claim 1 including a first plate having the valve hole formed therein and a second plate opposing the first plate and having the reed formed therein.

7. A fuel supply apparatus as claimed in claim 1 wherein the valve comprises a discharge valve for fuel discharged from the compression chamber.

8. A fuel supply apparatus as claimed in claim 1 wherein the valve comprises an intake valve for fuel introduced into the compression chamber.

* * * * *